US009970651B2

(12) United States Patent
Wang et al.

(10) Patent No.: US 9,970,651 B2
(45) **Date of Patent: *May 15, 2018**

(54) FURNITURE WITH LED LIGHT ARRANGEMENT

(71) Applicants: George Wang, City of Industry, CA (US); Lei Yang, City of Industry, CA (US)

(72) Inventors: George Wang, City of Industry, CA (US); Lei Yang, City of Industry, CA (US)

(73) Assignee: Import Direct, Inc., City of Industry, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/197,694

(22) Filed: Jun. 29, 2016

(65) Prior Publication Data

US 2016/0312994 A1 Oct. 27, 2016

Related U.S. Application Data

(63) Continuation of application No. 14/256,036, filed on Apr. 18, 2014, now Pat. No. 9,410,692.

(51) Int. Cl.

| | |
|---|---|
| ***F21V 33/00*** | (2006.01) |
| ***A47B 13/12*** | (2006.01) |
| ***F21S 4/00*** | (2016.01) |
| ***F21S 9/02*** | (2006.01) |
| ***F21V 23/04*** | (2006.01) |

(Continued)

(52) U.S. Cl.

CPC ..... *F21V 33/0012* (2013.01); *A47B 13/12* (2013.01); *A47C 1/00* (2013.01); *A47C 7/725* (2013.01); *A47C 31/00* (2013.01); *F21S 4/20* (2016.01); *F21S 9/02* (2013.01); *F21V 23/003* (2013.01); *F21V 23/006* (2013.01); *F21V 23/0464* (2013.01); *F21V 23/0471* (2013.01); *A47B 2220/0077* (2013.01);

(Continued)

(58) Field of Classification Search

CPC . A47B 13/08; A47B 13/12; A47B 2220/0077; F21S 9/02; F21S 4/20; F21V 23/0464; F21V 23/0471; F21V 33/0012; F21V 23/003; F21V 23/006; F21W 2131/301; F21Y 2103/20

See application file for complete search history.

(56) References Cited

U.S. PATENT DOCUMENTS 7,744,252 B2 * 6/2010 Maxik ..... A47B 96/021 362/249.02

FOREIGN PATENT DOCUMENTS

DE 202012101627 U1 * 6/2012 ..... F21V 19/005

OTHER PUBLICATIONS

Halemeier, Dec. 1, 2011, Patent Translate Powered by EPO and Google, Description DE202010007922, pp. 1-8.*

(Continued)

*Primary Examiner* — Alan Cariaso

(74) *Attorney, Agent, or Firm* — Raymond Y. Chan; David and Raymond Patent Firm

(57) ABSTRACT

An article of furniture includes a furniture body having a utilizing surface and a non-utilizing surface, and a light arrangement which includes a plurality of LEDs embedded in the non-utilizing surface of the furniture body for adding decorating and illuminating functions of the furniture body. The installation of the light arrangement is simple without disassembling the furniture body.

4 Claims, 6 Drawing Sheets

(51) Int. Cl.

| | |
|---|---|
| ***F21S 4/20*** | (2016.01) |
| ***A47C 1/00*** | (2006.01) |
| ***A47C 7/72*** | (2006.01) |
| ***A47C 31/00*** | (2006.01) |
| ***F21V 23/00*** | (2015.01) |
| *F21W 131/301* | (2006.01) |
| *F21Y 103/10* | (2016.01) |
| *F21Y 115/10* | (2016.01) |

(52) U.S. Cl.
CPC .... *F21W 2131/301* (2013.01); *F21Y 2103/10* (2016.08); *F21Y 2115/10* (2016.08)

(56) References Cited

OTHER PUBLICATIONS

L & S Deutschland GMBH, May 3, 2012, Patent Translate Powered by EPO and Google, Description DE202012101627, pp. 1-5.*

* cited by examiner

FURNITURE WITH LED LIGHT ARRANGEMENT

CROSS REFERENCE OF RELATED APPLICATION

This is a Continuation application that claims the benefit of priority under 35U.S.C. § 119 to a non-provisional application, application Ser. No. 14/256,036, filed Apr. 18, 2014.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an article of furniture, and more particularly to the furniture with a LED light arrangement provided at a non-utilizing surface of the furniture to provide an optimal light effect for adding decorating and illuminating functions of the furniture without occupying any utilizing surface thereof.

Description of Related Arts

Illuminated furniture, such as table, chair, or sofa, creates a luxurious and exciting atmosphere for home and hospitality. For example, an illuminated table comprises a light unit having a plurality of luminous elements placed under a tempered glass tabletop, such that the illuminated table forms a light box configuration to project the light from the luminous elements through the tempered glass tabletop. However, the light is directly projected toward the tempered glass tabletop such that bright spots are formed thereon. In other words, this design fails to provide an aesthetic appearance for the illuminated table.

Another example illustrates the luminous elements externally added to a bottom side of the tabletop to form the illuminated table. Accordingly, the light unit further comprises a container for housing the luminous elements and for being attached onto the bottom side of the tabletop. This illuminating box can enhance the aesthetic appearance for the illuminated table. However, the illuminating box will be protruded from the bottom side of the tabletop so as to reduce the leg room of the illuminated table. In other words, the illuminating box will be accidentally fallen from the tabletop when an external force is applied to the illuminating box. As a result, the illuminating box must be screwed to the bottom side of the tabletop that such configuration not only complicates the installation process of the light unit but also reduces the rigidity of the tabletop.

More importantly, the major drawback of the illuminated furniture is that the light unit must be electrically connected to a wall socket in order to electrically connect to the luminous elements. Since the illuminated table or chair is located far away from the wall, an extension cord is required for connecting the light unit to the wall socket. Especially for the illuminated chair being moved around the table, the extension cord will limit the movement of the furniture and will cause any accident when the user trips by the extension cord.

In addition, large furniture, such as sofa or bed, is inconvenience to install the light unit thereto. Due to the complicated power structure of the light unit, the electric circuit of the power is hard to install at the large furniture. In other words, the power structure needs a transformer box for converting the power, such that the configuration of the power structure affects the aesthetic effect of the furniture.

SUMMARY OF THE PRESENT INVENTION

A main object of the present invention is to provide an article of furniture, which comprises a LED light arrangement provided at a non-utilizing surface of the furniture to provide an optimal light effect for adding decorating and illuminating functions of the furniture without occupying any utilizing surface thereof Another object of the present invention is to provide the furniture, wherein the LED light arrangement is embedded in the non-utilizing surface of the furniture in order to hide the LED light arrangement.

Another object of the present invention is to provide the furniture which provides an indirect light so as to perform the decorative and illuminating function.

Another object of the present invention is to provide the furniture, wherein the LED light arrangement is powered by a power source supported by the furniture, such that no extension cord is required for connecting the LED light arrangement to any wall socket.

Another object of the present invention is to provide the furniture, wherein the LED light arrangement can be detachably coupled to the furniture without disassembling the furniture, such that the user is able to replace or interchange other LED light arrangements to provide different decorative and illuminating functions.

Another object of the present invention is to provide the furniture, wherein the light arrangement is light-depended so as to automatically turn on in the dark environment and turn off in the well-lighted environment.

Another object of the present invention is to provide the furniture, which does not require to alter the original structural design of the furniture, so as to keep the originally aesthetic design of the furniture without weakening the rigidity thereof.

Another object of the present invention is to provide the furniture, wherein the LED light arrangement is simple in structure, so the LED light arrangement is relatively easy to assemble.

Another advantage of the invention is to provide the furniture, wherein no expensive or complicated structure is required to employ in the present invention in order to achieve the above mentioned objects. Therefore, the present invention successfully provides an economic and efficient solution for providing a light configuration for the furniture with compact and ergonomic design.

Additional advantages and features of the invention will become apparent from the description which follows, and may be realized by means of the instrumentalities and combinations particular point out in the appended claims.

According, in order to achieve the above objects, the present invention provides an article of furniture, comprising, a furniture body having a utilizing surface and a non-utilizing surface; and a light arrangement which comprises a plurality of LEDs embedded in the non-utilizing surface of the furniture body for adding decorating and illuminating functions of the furniture body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
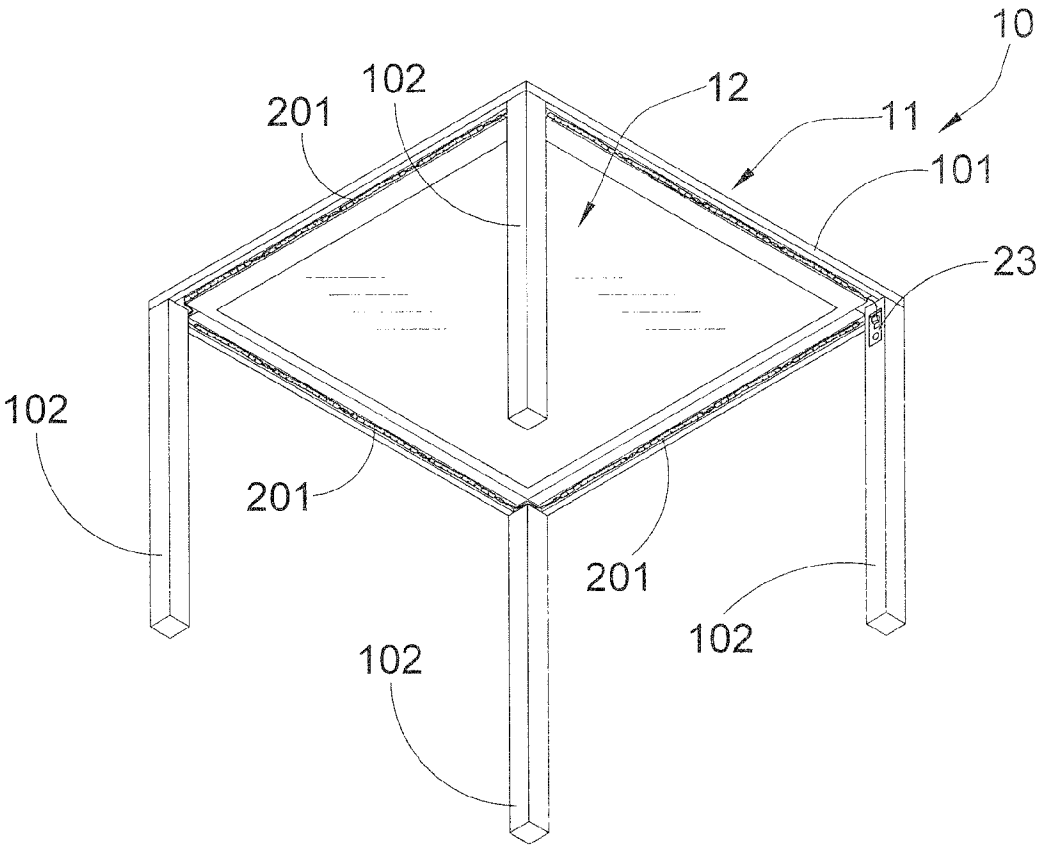
FIG. 1 is a bottom perspective view of an article of furniture with a light arrangement according to a preferred embodiment of the present invention, illustrating the light arrangement embedded into the bottom surface of a table.

Referring to FIG. 1 of the drawings, furniture according to a first preferred embodiment of the present invention comprises furniture body 10 having a utilizing surface 11 and a non-utilizing surface 12, and a light arrangement 20 embedded in the non-utilizing surface 12 of the furniture body 10 for adding decorating and illuminating functions of the furniture body 10.

According to the preferred embodiment, the furniture body 10 is shown as a table which comprises a tabletop panel 101 and a plurality of leg frames 102. The tabletop panel 101 has a top surface serving as the utilizing surface 11 and a bottom surface serving as the non-utilizing surface 12. Inner surfaces of the leg frames 102 also serve as the non-utilizing surface 12. In other words, the surfaces of the furniture body 10 where the user normally touches and utilizes defines as the utilizing surface 11 and the surfaces of the furniture body 10 where the user normally do not touch and utilize defines as the non-utilizing surface 12. In particular, the non-utilizing surface 12 of the furniture body 10 will normally be unseen and will face toward the ground surface.

The light arrangement 20 comprises a plurality of LEDs 21 embedded in the non-utilizing surface 12 of the furniture body 10 for generating a light effect thereat. Accordingly, since the LEDs 21 are electrically linked with each other and are embedded in the non-utilizing surface 12 of the furniture body 10, the user will normally not touch or reach the LEDs 21 during the normal use of the furniture body 10.

The light arrangement 20 further comprises a flexible light casing 22 sealedly receiving the LEDs 21 therein to form a light string 201 being embedded in the non-utilizing surface 12 of the furniture body 10. Accordingly, the flexible light casing 22 is a flat and elongated tape shaped casing 22, wherein the LEDs 21 are aligned with and sealed in the light casing 22. Preferably, each of the LEDs 21 is a diode sealed in the light casing 22 to minimize the thickness of the light casing 22. Therefore, the light string 201 can be flattened and embedded in the non-utilizing surface 12 of the furniture body 10.

According to the preferred embodiment, two or more light strings 201 are formed and are electrically linked with each other end-to-end. Depending on the size and shape of the non-utilizing surface 12 of the furniture body 10, the light strings 201 can be bent and extended to fit at the non-utilizing surface 12 of the furniture body 10. The user is able to replace one of the light strings 201 if the corresponding light string 201 is malfunctioned.

Figure 2:
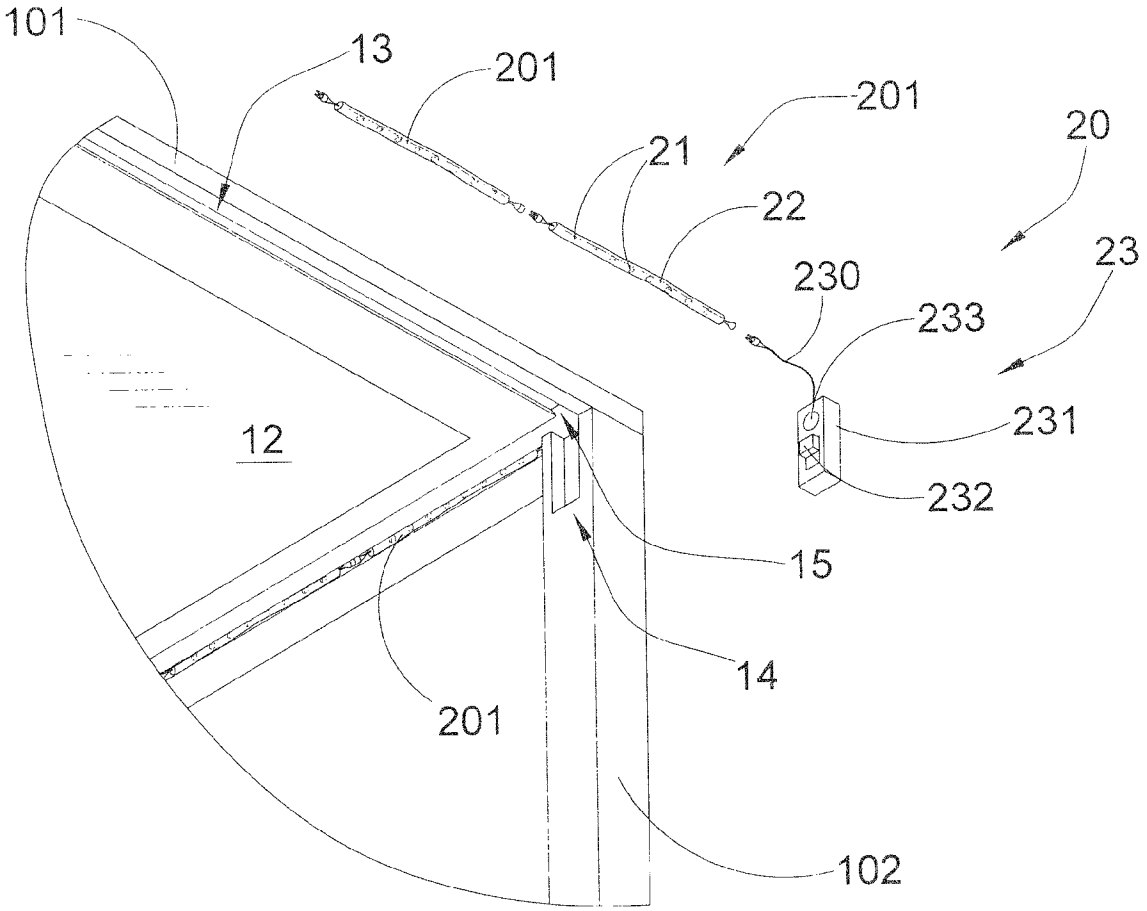
FIG. 2 is a perspective view of the light arrangement according to the above preferred embodiment of the present invention.

As shown in FIG. 2, the furniture body 10 further has at least a supporting groove 13 indented on the non-utilizing surface 12 of the furniture body 10 that the LEDs 21 are received in the supporting groove 13. In particular, the light string 201 is received in the supporting groove 13 to retain the LEDs 21 at the non-utilizing surface 12 of the furniture body 10. It is worth mentioning that the supporting groove 13 is pre-formed on the non-utilizing surface 12 of the furniture body 10 to guide the light strings 201 to be mounted thereon. For example, the supporting groove 13 is formed at the bottom surface of the tabletop panel 101 at the peripheral portion thereof, such that the light strings 201 are mounted and embedded in the bottom surface of the tabletop panel 101 at the peripheral portion thereof.

Figure 3:
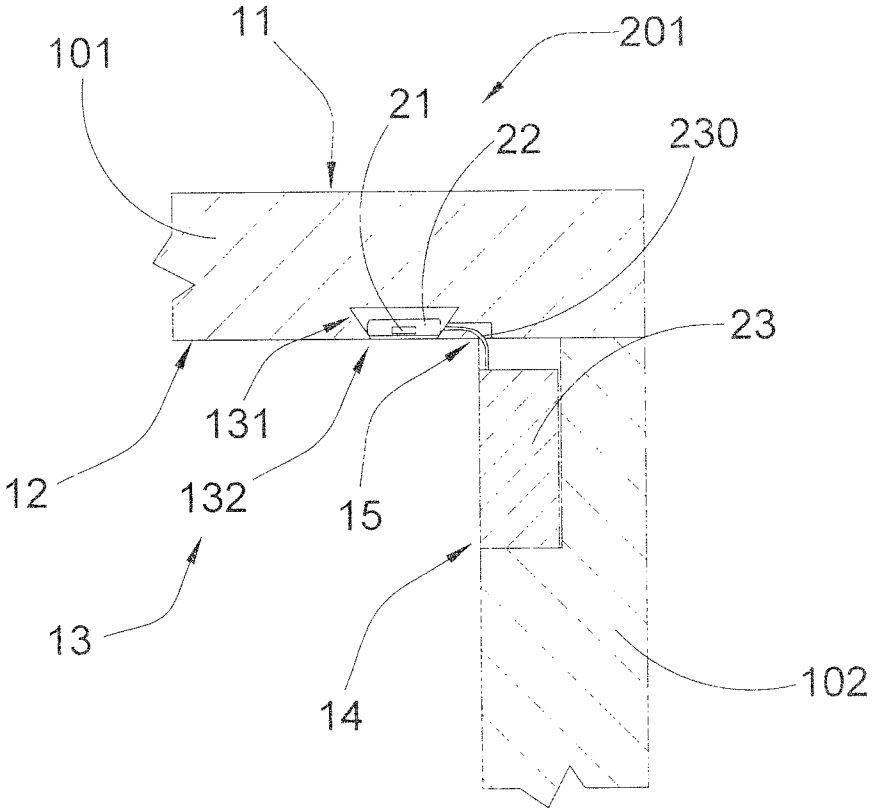
FIG. 3 is a sectional view of the light arrangement according to the above preferred embodiment of the present invention, illustrating the light string fitted into the supporting groove at the bottom surface of the furniture body.

Accordingly, the light strings 201 can be mounted to the non-utilizing surface 12 of the furniture body 10 without any tool or adhesive. As shown in FIG. 3, the supporting groove 13 has a dovetail shape defining an enlarged groove cavity 131 and a narrowed groove opening 132 for receiving the light string 201. A width of the narrowed groove opening 132 is slightly smaller than a size of the light string 201. Therefore, the light string 201 can be pushed into the groove cavity 131 of the supporting groove 13 through the narrowed groove opening 132 in order to securely retain the light string 201 along the supporting groove 13. The light string 201 can be pulled out of the groove cavity 131 of the supporting groove 13 in order to detach the light string 201 from the supporting groove 13. Preferably, the groove cavity 131 has a flat surface to engage with the light string 201 so as to align the LEDs 21 with the narrowed groove opening 132 of the supporting groove 13. Preferably, the light string 201 is embedded in the non-utilizing surface 12 of the furniture body 10 to form a flat non-protruding surface. In other words, a depth of the supporting groove 13 must be equal to or larger than the thickness of the light string 201.

Therefore, the light string 201 will be hidden and will not be protruded out of the non-utilizing surface 12 of the furniture body 10.

According to the preferred embodiment, the light arrangement 20 further comprises a control module 23 supported at the non-utilizing surface 12 of the furniture body 10 for controlling the LEDs 21. The control module 23 comprises a battery compartment 231 for receiving a battery therein to electrically link to the LEDs 21, and a control panel 232 provided on the battery compartment 231 to selectively control light effect and operation of the LEDs 21. Accordingly, the user is able to switch on and off the LEDs 21 via the control panel 232 and select different light effects such as different colors and/or flash patterns via the control panel 232.

The control module 23 further comprises an environmental sensor 233 operatively linked to the control panel 232 to selectively activate the LEDs 21. Preferably, the environmental sensor 233 can be a motion sensor and/or a light sensor. For example, when dining, the user' legs extend under the tabletop panel 101, such that the motion sensor will detect the motion to activate the LEDs 21. Likewise, the light sensor will activate the LEDs 21 when an ambient light intensity under the tabletop panel 101 is below a predetermined threshold.

As shown in FIG. 2, the furniture body 10 further has at least a receiving cavity 14 formed at the non-utilizing surface 12 of the furniture body 10 to receive the control module 23 thereat. Preferably, the receiving cavity 14 is formed at one of the leg frames 102 of the table at the inner side thereof, such that the control module 23 is hidden under the tabletop panel 101. However, the user is able to access the control module 23 easily. Preferably, a communication slot 15 is formed at the furniture body 10 to communicate the supporting groove 13 with the receiving cavity 14, wherein a connection cable 230 is extended from the control module 23 to the light string 201 through the communication slot 15.

Figure 4:
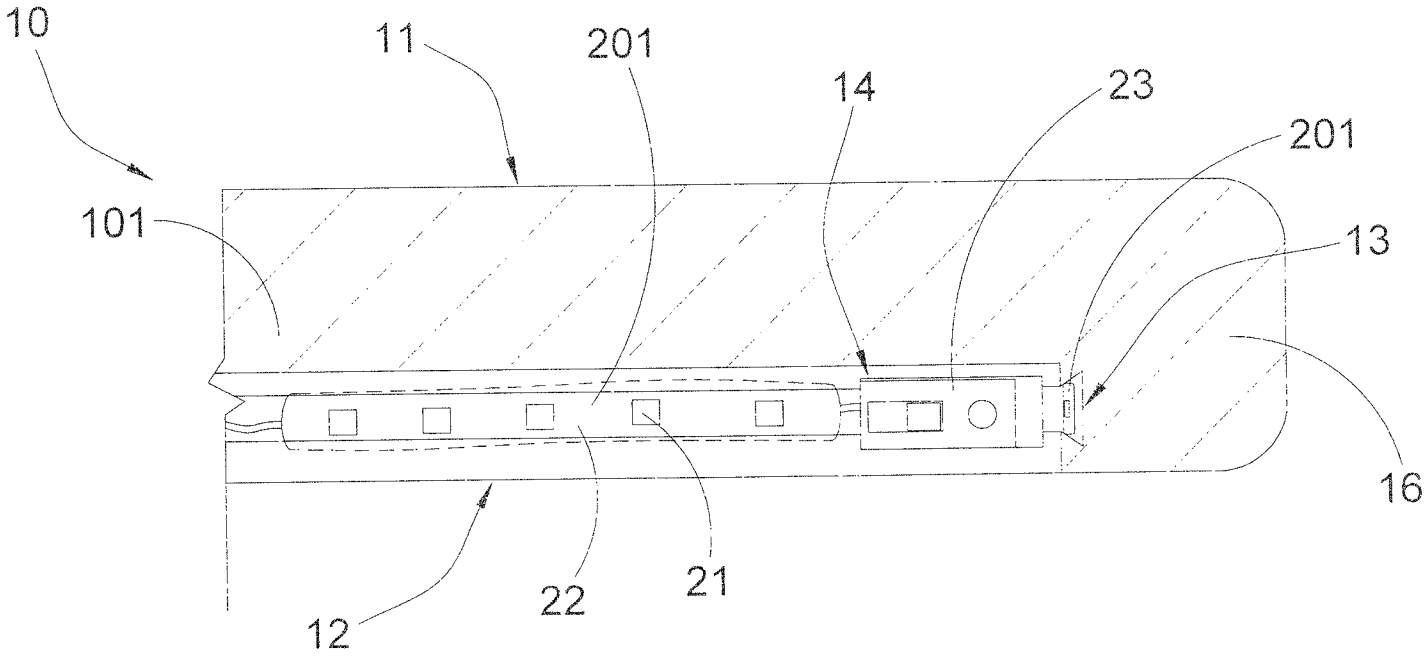
FIG. 4 illustrates an alternative mode of the light arrangement according to the above preferred embodiment of the present invention, illustrating the light string fitted into the supporting groove at the inner rim surface of the furniture body.

FIG. 4 illustrates an alternative mode of the furniture body 10 which further comprises a surrounding rim 16 downwardly extended from the tabletop panel 101 at the peripheral edge thereof, wherein the inner rim surface of the surrounding rim 16 also serves as the non-utilizing surface 12 of the furniture body 10. The supporting groove 13 is indent at the inner rim surface of the surrounding rim 16 to receive the light string 201 thereat. It is worth mentioning that the receiving cavity 14 is also formed at the inner rim surface of the surrounding rim 16, such that the control module 23 is received in the receiving cavity 14 at the inner rim surface of the surrounding rim 16.

Figure 5:
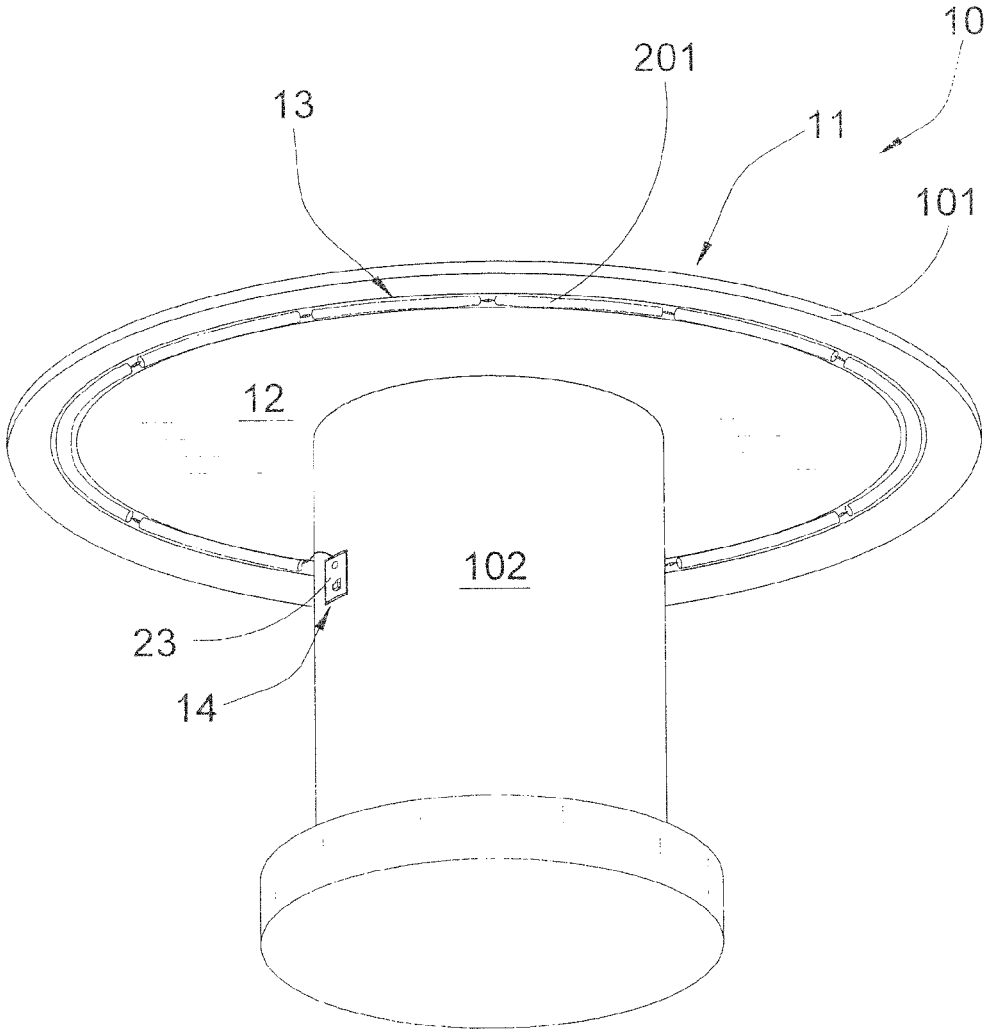
FIG. 5 is a perspective view of an alternative mode of the furniture according to the above preferred embodiment of the present invention, illustrating the circular shaped furniture body.

FIG. 5 illustrates another alternative mode of the furniture body 10, wherein the tabletop panel 101 is formed in circular shape and the leg frame 102 is downwardly extended from the center of the tabletop panel 101. Accordingly, the supporting groove 13 is indent at the bottom surface of the tabletop panel 101 to receive the light string 201 thereat. It is worth mentioning that the receiving cavity 14 is formed at the outer surface of the leg frame, such that the control module 23 is received in the receiving cavity 14 at the outer surface of the leg frame.

Figure 6:
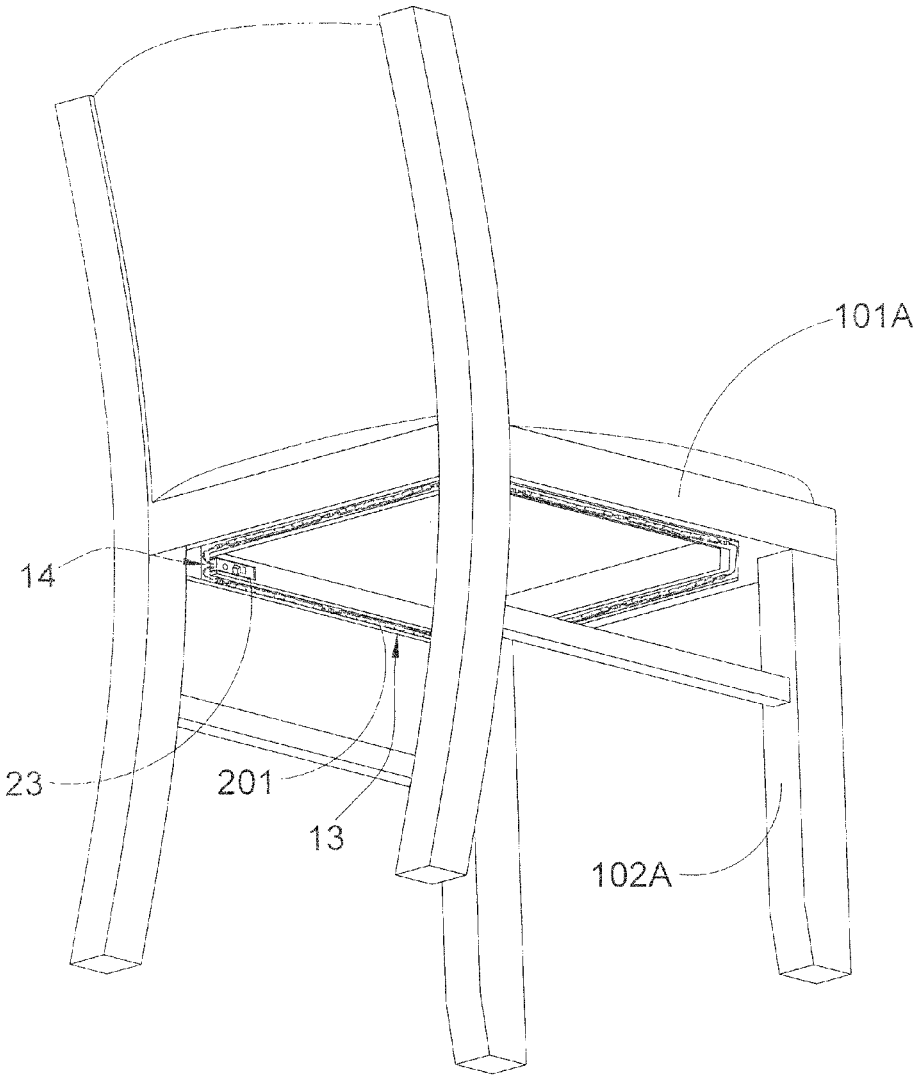
FIG. 6 is perspective view of an alternative mode of the furniture, illustrating the furniture being embodied as a chair.

FIG. 6 illustrate the furniture body 10 is a chair which comprises a sitting panel 101A and a plurality of leg frames 102A. Accordingly, the supporting groove 13 is indent at the bottom surface of the sitting panel to receive the light string 201 thereat. It is worth mentioning that the receiving cavity 14 is also formed at the bottom surface of the sitting panel 101A, such that the control module 23 is received in the receiving cavity 14 at the bottom surface of the sitting panel 101A.

It is worth mentioning that the present invention can be applied in any kinds of frame of the furniture, such as table, chair, bed, sofa, desk, and the like, for decoration and illumination. The installation of the light arrangement 20 will not require disassembling the furniture body 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A furniture, comprising:

a furniture body having a utilizing surface and a non-utilizing surface having at least a supporting groove; and a light arrangement which comprises one or more LEDs embedded in said supporting groove which defines an enlarged groove cavity; and a narrowed groove opening for receiving said light arrangement, wherein a width of said narrowed groove opening is slightly smaller than a size of said light arrangement, such that said light arrangement is pushed to securely retain in said supporting groove and pulled to detach from said supporting groove.

2. The furniture, as recited in claim 1, wherein said light arrangement further comprises a control module supported at said non-utilizing surface of said furniture body, wherein said control module comprises a battery compartment for receiving a battery therein to electrically link to said LEDs, and a control panel provided on said battery compartment to selectively control light effect and operation of said LEDs.

3. The furniture, as recited in claim 2, wherein said control module further comprises an environmental sensor operatively linked to said control panel to selectively activate said LEDs, wherein said environmental sensor is selected from a group consisting of motion sensor and light sensor.

4. The furniture, as recited in claim 3, wherein said furniture body comprises a tabletop panel having a top surface serving as said utilizing surface and a bottom surface serving as said non-utilizing surface, such that said light arrangement is formed at said bottom surface of said tabletop.

* * * * *